US006655542B2

(12) United States Patent
Koshikawa et al.

(10) Patent No.: US 6,655,542 B2
(45) Date of Patent: Dec. 2, 2003

(54) INK TANK

(75) Inventors: Hiroshi Koshikawa, Kanagawa (JP); Masanori Takenouchi, Kanagawa (JP); Shozo Hattori, Tokyo (JP); Hajime Yamamoto, Tokyo (JP); Eiichiro Shimizu, Kanagawa (JP); Fumitaka Goto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/340,721

(22) Filed: Jan. 13, 2003

(65) Prior Publication Data

US 2003/0132229 A1 Jul. 17, 2003

(30) Foreign Application Priority Data

Jan. 16, 2002 (JP) ..... 2002-007364

(51) Int. Cl.[7] ..... B65D 6/40

(52) U.S. Cl. ..... 220/661; 220/669; 220/550; 220/62.22; 220/62.18

(58) Field of Search ..... 220/661, 669, 220/592.28, 592.27, 62.22, 62.18

(56) References Cited

U.S. PATENT DOCUMENTS

| | | | | |
|---|---|---|---|---|
| 3,419,173 A | * | 12/1968 | Verlinden | 220/4.05 |
| 3,847,248 A | * | 11/1974 | Avery | 184/109 |
| 4,057,163 A | * | 11/1977 | Widart et al. | 376/294 |
| 4,969,747 A | * | 11/1990 | Colin et al. | 366/339 |
| 5,531,255 A | * | 7/1996 | Vacca | 141/285 |
| 5,702,023 A | * | 12/1997 | Ehs | 220/582 |

* cited by examiner

*Primary Examiner*—Joseph M. Moy
(74) *Attorney, Agent, or Firm*—Fitzpatrick, Cella, Harper & Scinto

(57) ABSTRACT

An ink tank producing a stable negative pressure regardless of material used is provided. In the ink tank, inner and outer walls include a bonding region having a bonding force distribution. With this arrangement, since the inner wall separates from the outer wall as ink in the ink tank is being guided out, the area of a non-bonding region increases.

6 Claims, 9 Drawing Sheets

BONDING FORCE DISTRIBUTION

INNER-WALL THICKNESS DISTRIBUTION

NUMBER DENSITY DISTRIBUTION OF PROJECTIONS

INK TANK

BACKGROUND OF THE INVENTION

1. Field of the Invention

The present invention relates to ink tanks used in inkjet recording, and more particularly relates to an ink tank having an inner flexible ink containing portion for storing liquid such as ink and an outer casing for protecting the containing portion.

2. Description of the Related Art

An ink tank used in inkjet recording is required to produce an adequate negative pressure so as to feed liquid to a recording head which discharges liquid such as ink. Moreover, an ink tank, which is mounted on a carriage of a recording apparatus and which is detachable together with a recording head from the recording apparatus, is required to have a large ink-storing capacity, a small number of components, and a simple structure, in addition to having recyclable components.

To solve these problems, the same assignee disclosed an innovative liquid container, which is formed by blow molding, in U.S. Pat. No. 5,975,330. The liquid container has an outer wall having an atmospheric-air communicating portion and an approximate polygonal or prism-like shape, an inner wall which has outer surfaces substantially the same as or similar to inner surfaces of the outer wall and which forms a liquid containing portion for storing liquid therein, and a liquid feeding port. The liquid container is constructed such that the thickness of the inner wall is greater at the central part of each surface thereof than at the periphery of the surface (i.e., at corners and vertices of the polygon), and the inner and outer walls are separable from each other. In the liquid container, as liquid is being guided out from the liquid container, the largest surfaces of the inner wall which form a part of the polygon are first separated from the outer wall, and the corners of the inner wall remain attaching to the corresponding corners of the outer wall until the mutually opposing surfaces of the inner wall contact each other, thereby allowing the liquid ink container to produce a stable negative pressure.

SUMMARY OF THE INVENTION

However, depending on the kind of resin material used for the inner wall or when the inner wall is very thin, there is a risk in that a desired negative pressure is not obtained because a produced negative pressure is too small, or the liquid is not smoothly guided out from the containing portion because a part of the inner wall in the vicinity of the liquid feeding port is deformed.

It is an object of the present invention to provide an ink tank which addresses the foregoing problems and which produces a stable negative pressure and feeds liquid over a large range of thicknesses of the inner wall and with a variety of different kinds of resin material used for the inner wall.

To achieve the above objects, an ink tank according to the present invention comprises an inner wall forming a liquid containing portion for storing liquid; an outer wall, having inner surfaces whose shapes are substantially the same as those of outer surfaces of the inner wall, comprising at least one atmospheric-air communicating portion for introducing atmospheric air into a space between the inner wall and the inner surfaces of the outer wall; and a liquid feeding port for feeding liquid in the liquid containing portion to the outside.

The inner wall is separable from the outer wall as the liquid is being guided out from the liquid feeding port. The ink tank further comprises a first region in which the inner and outer walls are bonded to each other and are separable from each other by an external force; and a second region, next to the first region, in which the inner and outer walls are bonded to each other and a larger external force is needed to separate the inner wall from the outer wall than in the first region. As the liquid is being guided out, the inner wall separates from the outer wall first in the first region and then in the second region.

According to the foregoing ink tank, since a deformable region of the inner wall which is deformed as ink is being guided out can be freely set, the liquid feeding port is not blocked by the deformed inner wall. Also, since the area of the deformable region increases as the ink is being guided out, the negative pressure in the ink tank varies in a predetermined range as the ink is being guided out, thereby allowing the ink tank to produce a stable negative pressure.

Another ink tank according to the present invention comprises an inner wall having an approximate polygonal or prism-like shape and forming a liquid containing portion for storing liquid; an outer wall, having inner surfaces whose shapes are substantially the same as those of outer surfaces of the inner wall, comprising at least one atmospheric-air communicating portion for introducing atmospheric air into a space between the inner wall and the inner surfaces of the outer wall; and a liquid feeding port for feeding liquid in the liquid containing portion to the outside. The inner wall is separable from the outer wall as the liquid is being guided out from the liquid feeding port. Also, the liquid feeding port is disposed on a surface of the inner wall except the largest-area surface of the same. In addition, a thickness distribution of each largest-area surface of the inner wall varies continuously so as to become larger from a position remote from the liquid feeding port toward the liquid feeding port.

According to the foregoing ink tank, since the separation of the inner wall begins to occur from a portion of the inner wall far away from the ink feeding port as the ink is being guided out, the liquid feeding port is not blocked by the deformed inner wall regardless of the kind of resin. Also, the thickness distribution determines the order of deforming portions of the inner wall, thereby allowing the ink tank to produce a stable negative pressure.

Further objects, features and advantages of the present invention will become apparent from the following description of the preferred embodiments with reference to the attached drawings.

BRIEF DESCRIPTION OF THE DRAWINGS

FIGS. 1A and 1B are schematic perspective views of an ink tank according to a first embodiment of the present invention, wherein FIGS. 1A and 1B illustrate states in which ink stored in the ink tank begins to be guided out and half the ink has been guided out, respectively.

FIGS. 6A and 6B are schematic perspective views of an ink tank according to a second embodiment of the present invention, wherein FIGS. 6A and 6B illustrate states in which ink stored in the ink tank begins to be guided out and half the ink has been guided out, respectively.

FIGS. 9A and 9B are schematic perspective views of an ink tank according to a third embodiment of the present invention, wherein FIGS. 9A and 9*b* illustrate states in which ink stored in the ink tank begins to be guided out and half the ink has been guided out, respectively.

DESCRIPTION OF THE PREFERRED EMBODIMENTS

Preferred embodiments of the present invention will be described in detail with reference to the attached drawings.

First Embodiment

Figure 1A:
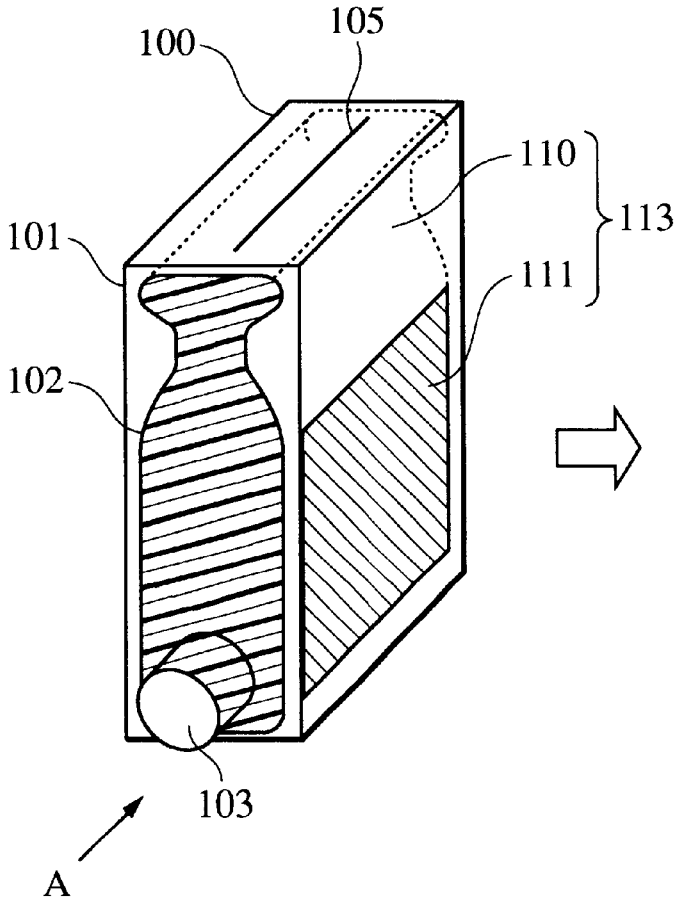
Figure 1B:
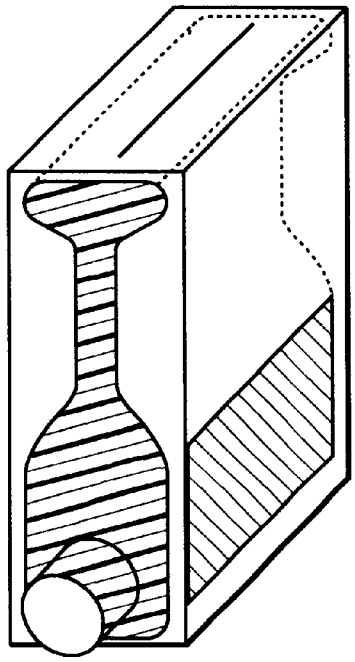

FIGS. 1A and 1B are schematic perspective views of an ink tank according to a first embodiment of the present invention, wherein FIGS. 1A and 1B illustrate states in which ink stored in the ink tank begins to be guided out and half the ink has been guided out, respectively.

As shown in FIGS. 1A and 1B, an ink tank 100 having a rectangular parallelepiped shape has an outer wall 101 forming an outer enclosure and an inner wall 102 which has outer surfaces whose shapes are substantially the same as those of the inner surfaces of the outer wall and which is separable from the outer wall. Ink is stored in a region enclosed by the inner wall 102 (hereinafter, referred to as an ink containing portion). Since the outer wall 101 is relatively thicker than the inner wall 102, the outer wall 101 is relatively more rigid and is rarely deformed even when the inner wall 102 is deformed due to the flowing-out of the ink. The outer wall 101 has atmospheric-air communicating portions 105 for communicating air, in spaces between the outer surfaces of the inner wall and the inner surfaces of the outer wall, with atmospheric air. In this embodiment, the atmospheric-air communicating portions 105 utilize pinch-off portions which are formed when the ink tank is formed by blow-molding and in which the inner wall 102 is clamped by the outer wall 101 so as to be detachable from the outer wall. If necessary, an unshown atmospheric-air portion is disposed at the bottom of the ink tank 100. In addition, the ink tank 100 has an ink feeding port 103, at the lower part of the outer wall 101, for coupling the ink containing portion with an ink-conducting tube of an inkjet recording head (not shown).

The inner wall 102 has two surfaces 113 whose areas are the largest (hereinafter, referred to as largest-area surfaces). Most of each largest-area surface 113 is a bonding region 111, that is, a deformation-suppressed region, which is bonded to the outer wall 101, and the remaining upper part of the inner wall 102 is a non-bonding region 110, that is, a deformable region, which is not bonded to the outer wall 101.

Figure 2:
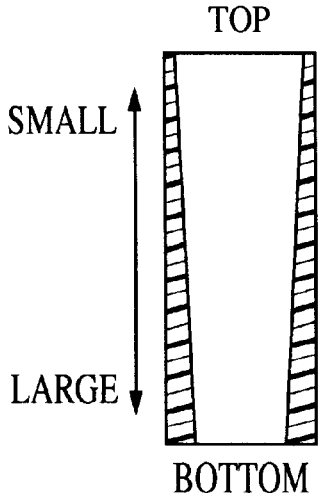
FIG. 2 is a schematic view illustrating the bonding force distribution between the inner wall and the outer wall of the ink tank according to the first embodiment.

Next, the bonding method between the outer wall 101 and the inner wall 102 and the forming method of the non-bonding region 110 will be described. The outer and inner walls 101 and 102 are composed of different thermoplastic resins which are not mutually meltable with each other. By inserting a parison having these thermoplastic resins concentrically disposed therein into a metal mold and by forming them so as to abut against the shape of the mold by introducing air into the metal mold, the ink tank according to the present invention is formed by blow-molding. Depending on the molding pressure and temperature, the resins in the vicinity of the boundary layer between the inner and outer walls exhibit a weak adhesion. With this feature, by partially changing the temperature of the metal mold, the foregoing bonding region 111 is easily provided, and furthermore, the bonding strength can be varied in the bonding region as shown in FIG. 2. In this embodiment, the ink tank is formed so that the bonding force of the bonding region close to the ink feeding port is greater than that remote from the ink feeding port. The non-bonding region 110 is formed such that the inner and outer walls in the bonding region having the above-described weak bonding adhesion are separated from each other in advance by partially exerting an external force on the bonding region after the blow-molding. As another method for forming the bonding region, both outer and inner walls may be partially composed of a meltable resin or an adhesive agent may be applied on the outer and inner walls after the blow-molding.

Figure 3:
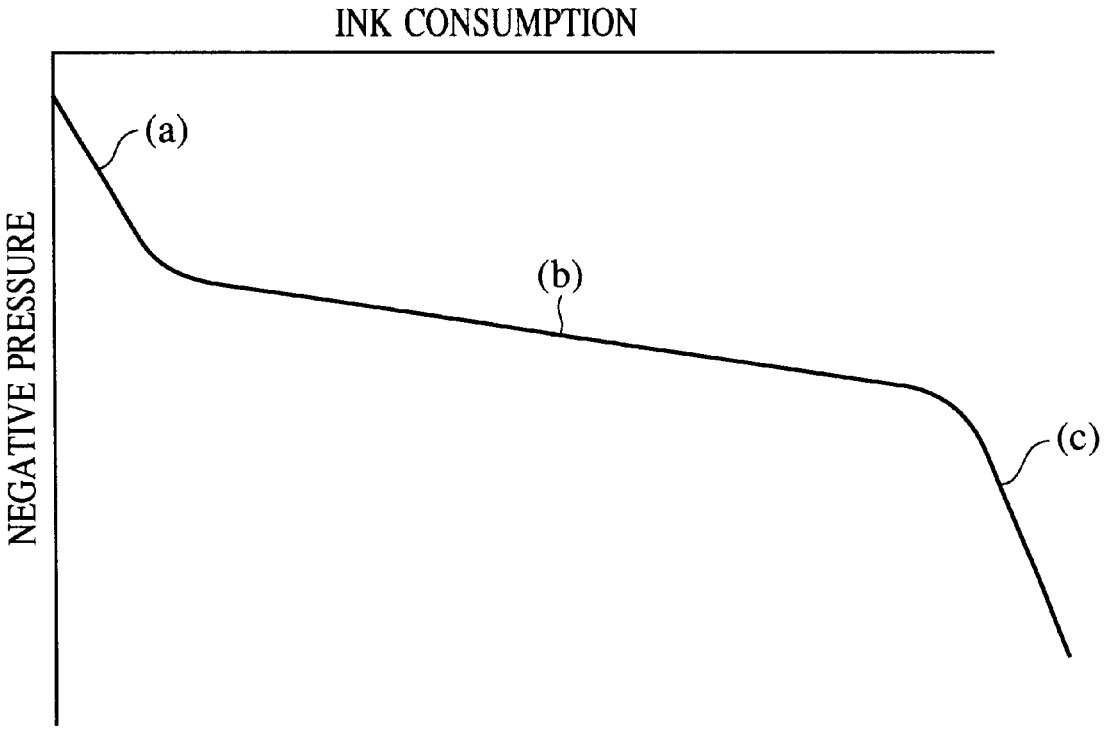
FIG. 3 illustrates negative pressure vs. ink consumption as the ink is being guided out from the ink tank according to the first embodiment.

Referring now to FIG. 3, the relationship between the state of the inner wall 102 and the negative pressure produced in the ink tank shown in FIGS. 1A and 1B after ink in the ink tank begins to be guided out will be described.

Immediately after the ink begins to be guided out, the non-bonding region 110 of the inner wall 102 is locally deformed as shown in FIG. 1A. Since the pinch-off portions are formed at the upper and lower surfaces of the ink tank 100 in this embodiment, these surfaces are not deformed as the ink is being guided out.

Since the area of the non-bonding region 110 is much smaller than that of the foregoing largest-area surface 113 of the inner wall, the stiffness of the non-bonding region 110 is larger than that of the entire largest-area surface which is completely separated from the outer wall. Accordingly, as the ink is being guided out, a large change in the negative pressure occurs as shown in an initial region (a) in FIG. 3.

When the ink is guided out subsequently and the non-bonding region 110 is deformed on a large scale, as shown in FIG. 1B, the bonding surface of the bonding region 111 next to the non-bonding region 110 starts to be separated from the outer wall, thus leading to an increase in the area of the non-bonding region 110. As a result, the stiffness of the non-bonding region 110 becomes smaller and, as the ink is being guided out, a small change in the negative pressure occurs as shown in a middle region (b) in FIG. 3, at which the negative pressure remains relatively stable and constant.

This situation will be described in detail with reference to FIGS. 4 and 5. FIG. 4 is a schematic view of the ink tank viewed from the arrow A indicated in FIG. 1, illustrating a state in which the inner wall is deformed. FIG. 5 illustrates a change in the spring constant of the inner wall, in accordance with a deformation of the inner wall, shown in a graph of a repulsive force F vs. a displacement X of the inner wall, where the displacement of the inner wall is defined as the maximum distance of the inner wall from the outer wall.

In FIGS. 4A to 4D, the atmospheric-air communicating portion 105 is shown at the sides of the ink tank, rather than in their actual position at the top (and bottom) thereof. This was done to simplify the depiction of air flow into the spaces between the outer and inner walls, since the actual size of some of the spaces can be somewhat small and therefore difficult to depict with clarity.

Figures 4A, 4B, 4C, 4D:
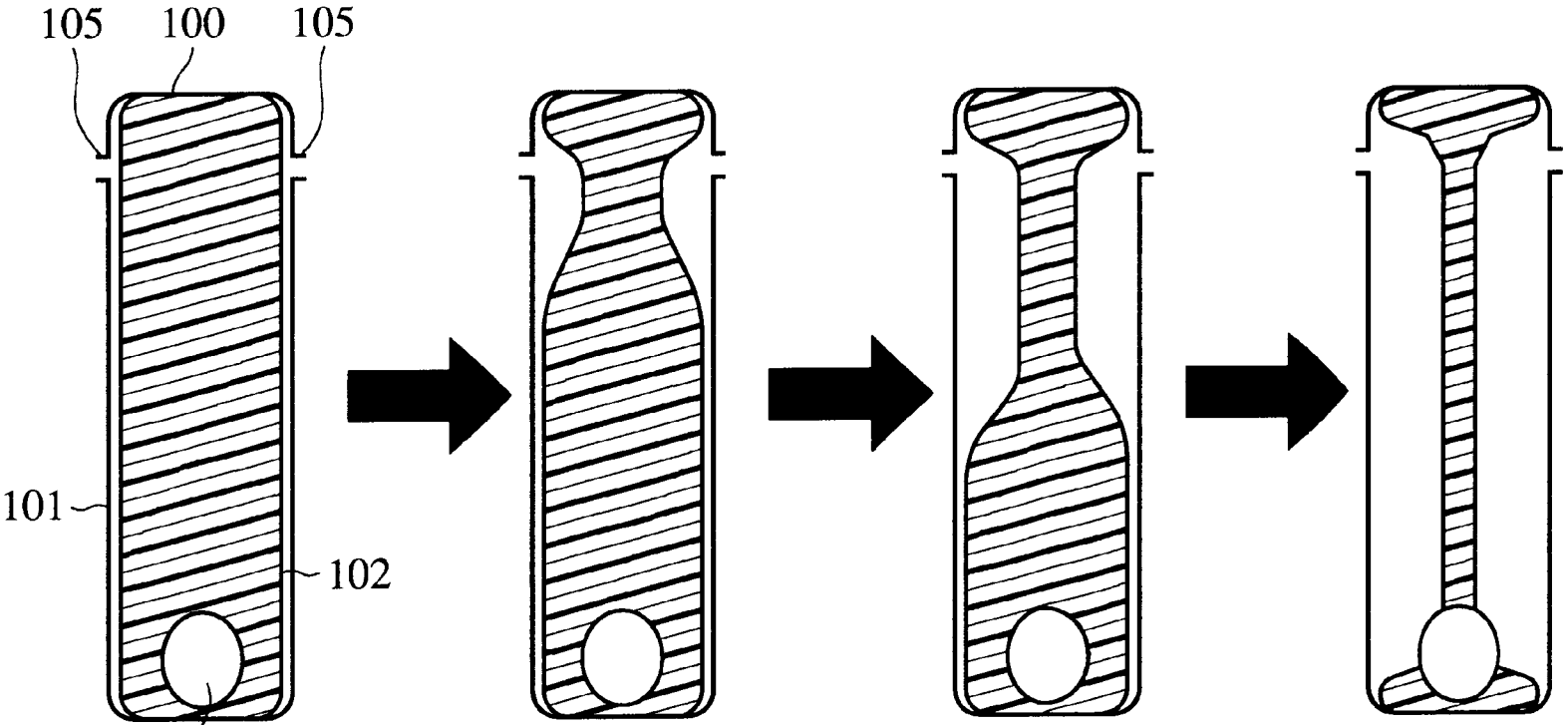
FIGS. 4A to 4D are schematic views of the ink tank viewed from the arrow A indicated in FIG. 1A, illustrating a state in which the inner wall of the ink tank is deformed.
Figure 5:
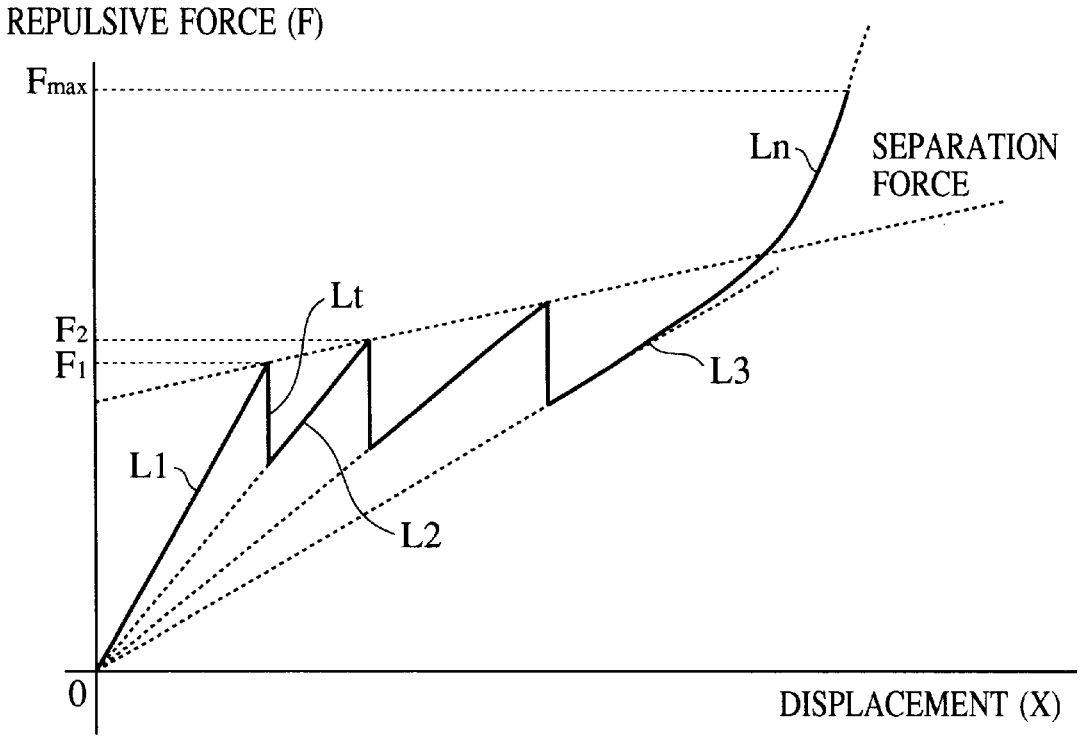
FIG. 5 illustrates a change in the spring constant of the inner wall, as the inner wall is being deformed, shown in a graph of a repulsive force vs. a displacement of the inner wall.

FIG. 4A illustrates a state in which the ink is not guided out. After the ink starts to be guided out, only the non-bonding region, i.e., the deformable region 110 is locally deformed as shown in FIG. 4B. Atmospheric air is introduced in the spaces between the outer and inner walls 101 and 102 via the atmospheric-air communicating portions 105, thereby causing the inner wall to be smoothly deformed.

As mentioned-above, the area of the non-bonding region 110 is much smaller than that of the largest-area surface 113 of the inner wall, and the non-bonding region has a large stiffness, i.e., a large spring constant compared to a state in which the whole region of the largest-area surface is freely deformable. Accordingly, the spring constant of the inner wall 102 in the state shown in FIG. 4B is large as seen from the gradient of a straight line L1 shown in FIG. 5.

When the ink continues to be guided out, the displacement X of the non-bonding region 110 becomes larger, causing the repulsive force F to reach a certain value F1. Since the bonding force of the bonding region 111 is set such that the inner wall starts to be separated from the outer wall at the repulsive force F1, the area of the bonding region 111 starts to become smaller, that is, the non-bonding region 110 starts to increase as shown in FIG. 4C. As the non-bonding region 110 increases, the area of the deformable region becomes larger, resulting in a decrease in the spring constant of the non-bonding region. This situation is illustrated in FIG. 5 such that the displacement vs. repulsive force characteristic of the inner wall 102 shifts from the line L1 to a line L2, having a smaller gradient than the line L1, via a line Lt shown in FIG. 5. Preferably, the inner wall starts to be separated from the outer wall by the repulsive force F in the range of 500 to 1500 Pa.

As the separation of the bonding region 111 advances as shown in FIG. 4C, the spring constant of the non-bonding region 110 becomes smaller because its area has become larger. Accordingly, the displacement vs. repulsive force characteristic in FIG. 5 shifts sequentially from one line to another line which has a smaller gradient than the former line every time when the repulsive force sequentially reaches F1, F2, - - - (F1<F2<- - - ).

This situation continues until the bonding region 111 is completely separated, and the separation force in this period is maintained in a predetermined range. When the bonding region is completely separated and the whole inner wall 102 becomes the non-bonding region 110 as shown in FIG. 4D, the amount of the ink stored in the inner wall 102 becomes small and the repulsive force after then becomes large sharply, as shown by a line Ln in FIG. 5.

It is considered that the negative pressure characteristic shown in FIG. 3 is obtained by replacing the displacement and the repulsive force of the displacement vs. repulsive force characteristic shown in FIG. 5 with the ink consumption and the negative pressure, respectively. Although the displacement vs. repulsive force characteristic is represented by discontinuous lines since the above-description is schematically made, the actual displacement vs. repulsive force characteristic is not represented by such discontinuous lines but is represented by a smooth line in a similar fashion to the negative-pressure characteristic curve shown in FIG. 3. Such a negative pressure curve indicates that the ink tank produces a proper negative pressure for feeding ink to an inkjet recording head.

In this embodiment, as shown in FIG. 2, the bonding force is distributed so as to become larger from the top to the bottom of the ink tank so that the separation of the inner wall occurs from a portion of the inner wall far away from the ink feeding port 103 toward the ink feeding port 103. It is desirable to distribute the largest bonding force in the vicinity of the ink feeding port 103 so as to prevent the inner wall from separating from the outer wall and blocking the ink feeding port.

Second Embodiment

Figure 6A:
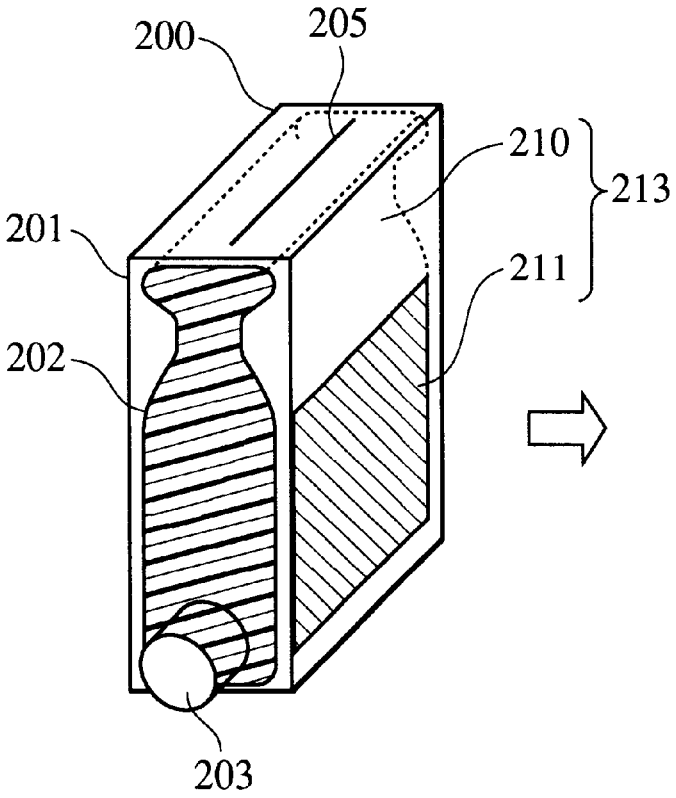
Figure 6B:
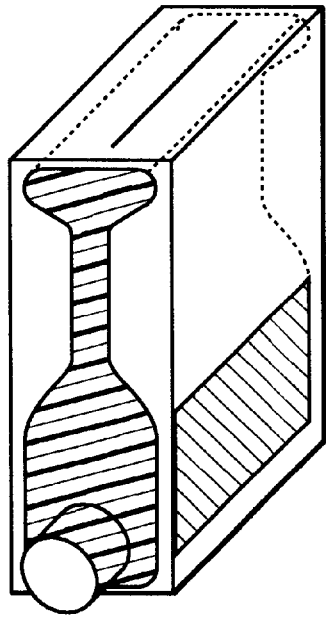

FIGS. 6A and 6B are schematic perspective views of an ink tank according to a second embodiment of the present invention, wherein FIGS. 6A and 6B illustrate states in which ink stored in the ink tank begins to be guided out and half the ink has been guided out, respectively.

Figure 7:
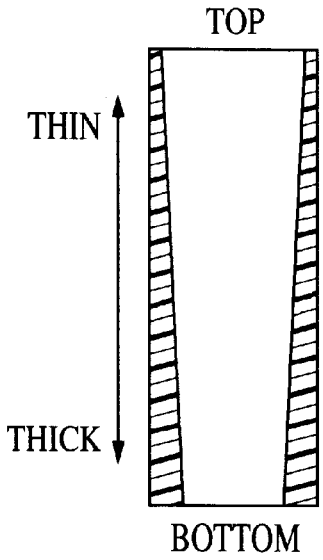
FIG. 7 is a schematic view illustrating the thickness distribution of the inner wall of the ink tank according to the second embodiment.

In this embodiment, the inner and outer walls are not bonded to each other as in the first embodiment. Instead, the inner wall is provided with a thickness distribution as shown in FIG. 7. Like parts are identified by similar reference numerals as those in the first embodiment, and their descriptions are omitted.

Figure 8:
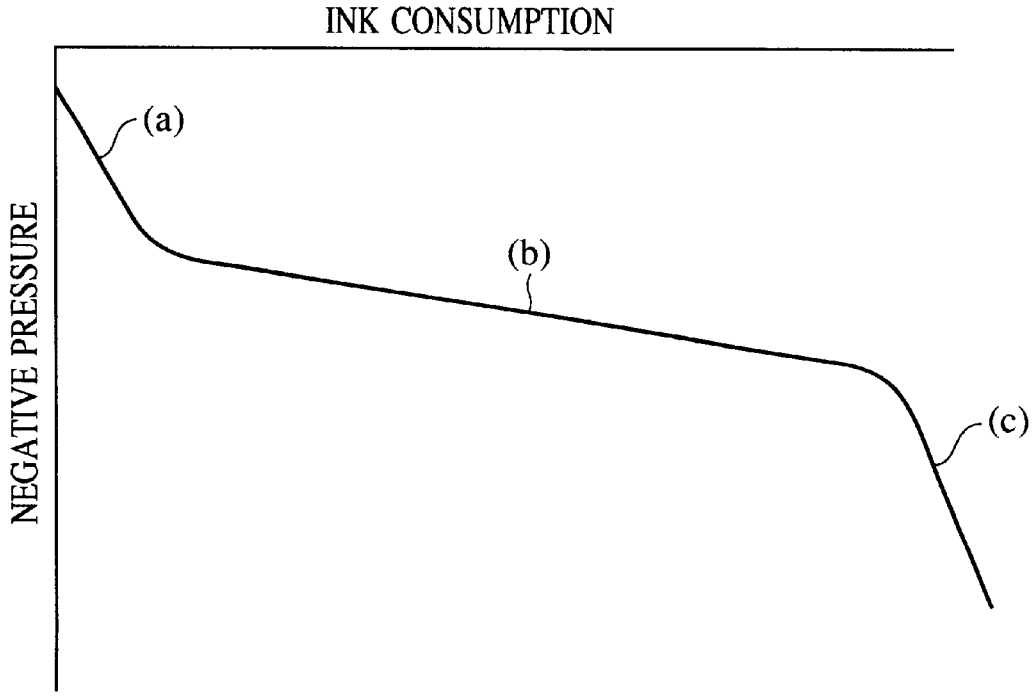
FIG. 8 illustrates a negative pressure vs. ink consumption as the ink is being guided out from the ink tank according to the second embodiment.

In this embodiment, as schematically shown in FIG. 7, an inner wall 202 has a thickness distribution which increases from a portion of the inner wall, the farthest away from an ink feeding port 203, toward the ink feeding port 203. With this thickness distribution of the inner wall, as the ink is being guided out, the ink tank according to the second embodiment is deformed from a state shown in FIG. 6A to another state shown in FIG. 6B in the same fashion as in the first embodiment, so that the ink tank produces a stable negative pressure as shown in FIG. 8.

The thickness distribution can be obtained using the flow molding techniques described in the aforementioned U.S. Pat. No. 5,975,330.

Those skilled in the art will appreciated that, as the ink is being guided out, the ink tank is similarly deformed and produces a stable negative pressure. The bonding distribution of the first embodiment and the thickness distribution of the second embodiment may be combined.

Third Embodiment

Figure 9A:
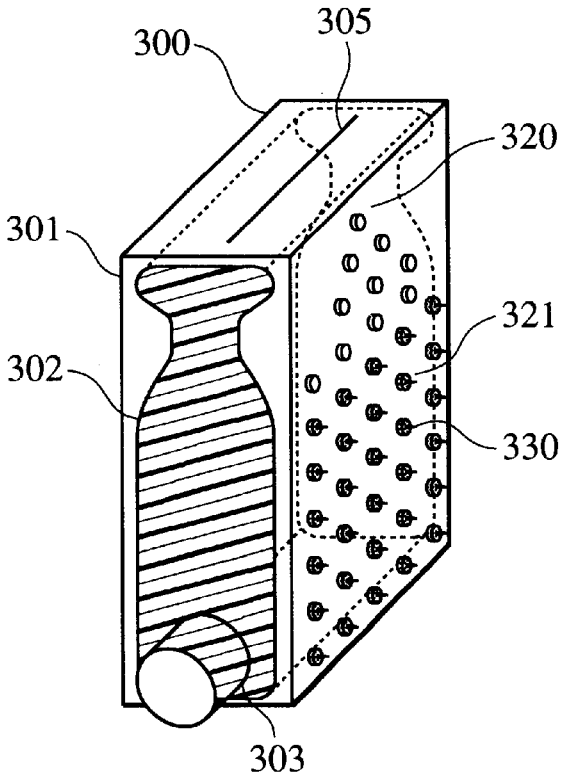
Figure 9B:
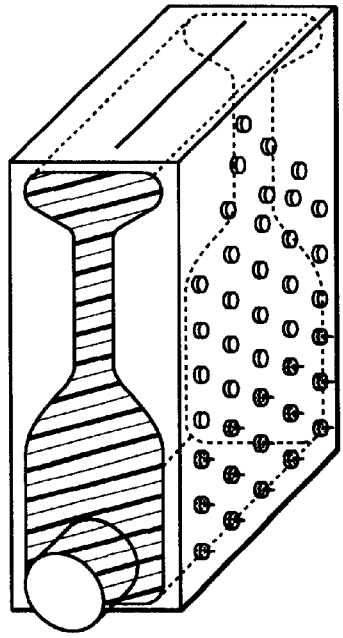
Figure 12:
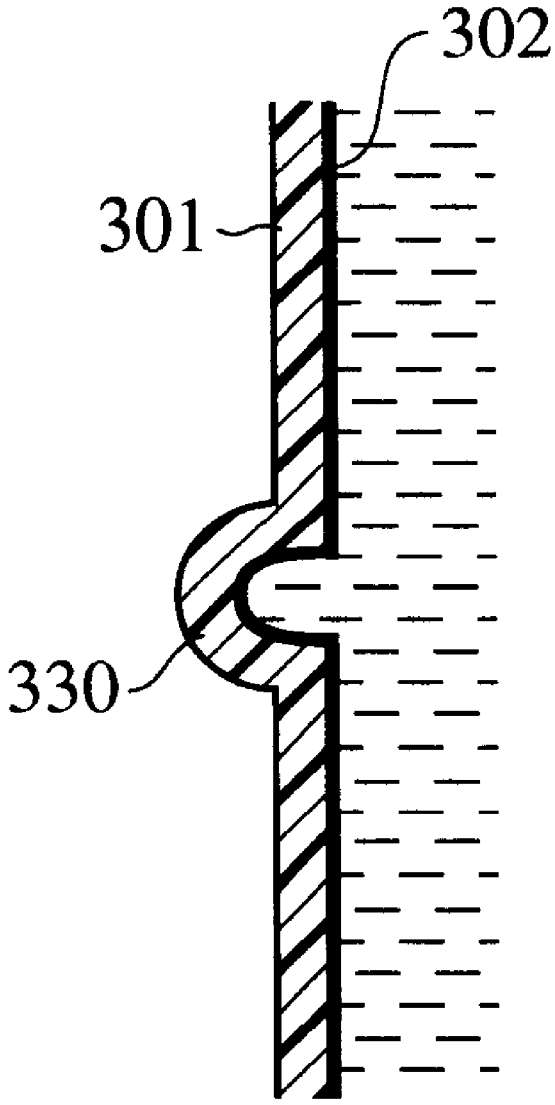
FIG. 12 is a partial sectional view showing details of engaged projections in the third embodiment.

FIGS. 9A and 9B are schematic perspective views of an ink tank according to a third embodiment of the present invention, wherein FIGS. 9A and 9*b* illustrate states in which ink stored in the ink tank begins to be guided out and half the ink has been guided out, respectively. FIG. 12 is a partial sectional view showing engagement of projections according to the third embodiment.

Figure 10:
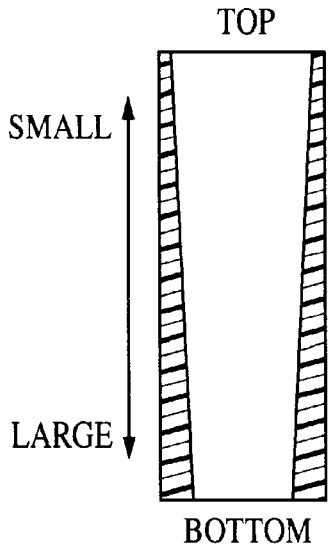
FIG. 10 is a schematic view illustrating the distribution of the number density of projections of the ink tank according to the third embodiment.

In this embodiment, the inner and outer walls are not bonded to each other as in the first embodiment. Instead, the inner and outer walls have mutually corresponding projections 330 as shown in FIG. 12 and are provided with a number density distribution of the projections as shown in FIG. 10. A projection separation region 320 is a deformable region substantially the same as the foregoing non-bonding region and a projection engaging region 321 is a deformation-suppressed region substantially the same as the foregoing bonding region. Like parts are identified by similar reference numerals as those in the previous embodiments and their descriptions are omitted.

Figure 11:
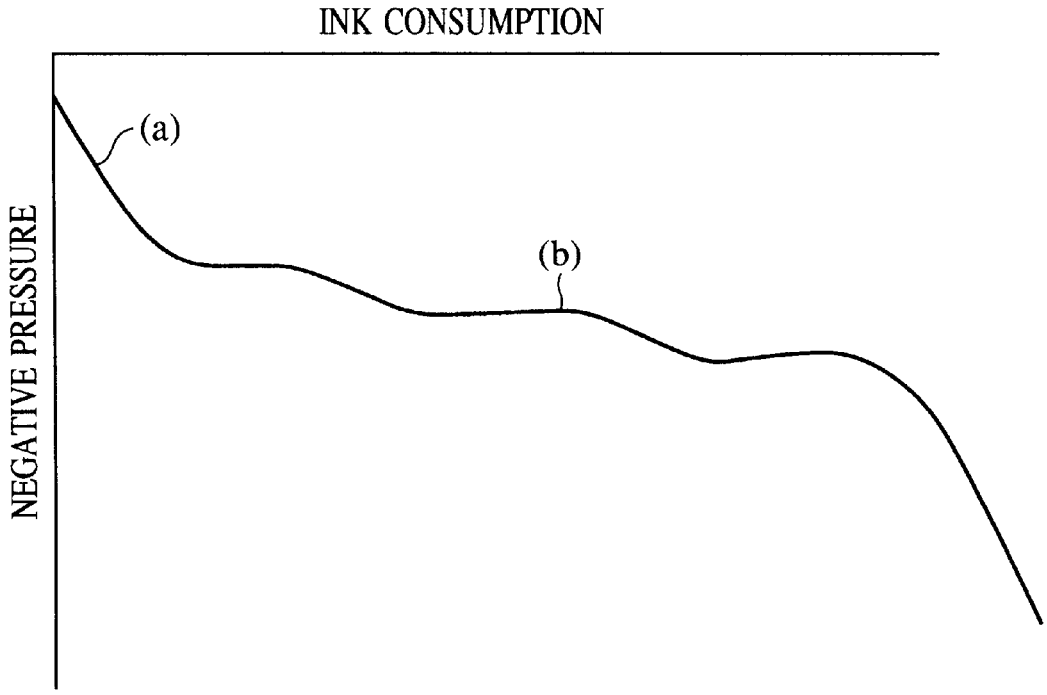
FIG. 11 illustrates a negative pressure vs. ink consumption as the ink is being guided out from the ink tank according to the third embodiment.

In this embodiment, as the ink is being guided out, the negative pressure is produced in a somewhat fluctuated manner as shown in FIG. 11, which is different from producing the negative pressure in the first and second embodiments, since the projections are disposed in a discrete manner.

Each projection 330 may be projected or depressed or may have a semi-spherical shape or a rectangular parallelepiped shape as long as it satisfies its required function of separable engagement. Also, instead of varying the number density of the projections, a force needed for separating the inner wall from the outer wall may be varied by changing the shapes of the projections.

As described above, the present invention easily provides an ink tank which offers a stable negative pressure characteristic regardless of the kind of resin material used.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. For example, the characterizing features of each of the embodiments can be combined with those of other embodiments. The scope of the following claims is to be accorded the broadest interpretation so as to encompass all such modifications and equivalent structures and functions.

What is claimed is:

1. An ink tank comprising:

an inner wall forming a liquid containing portion for storing liquid;

an outer wall, having inner surfaces whose shapes are substantially the same as those of outer surfaces of the inner wall, comprising at least one atmospheric-air communicating portion for introducing atmospheric air into a space between the inner wall and the inner surfaces of the outer wall; and a liquid feeding port for feeding liquid in the liquid containing portion to the outside, wherein the inner wall is separable from the outer wall as the liquid is being guided out from the liquid feeding port, the ink tank further comprising:

a first region in which the inner and outer walls are bonded to each other and are separable from each other by an external force; and a second region, next to the first region, in which the inner and outer walls are bonded to each other and a larger external force is needed to separate the inner wall from the outer wall than in the first region, wherein, as the liquid is being guided out, the inner wall separates from the outer wall first in the first region and then in the second region.

2. The ink tank according to claim 1, wherein the second region is disposed closer to the liquid feeding port than the first region.

3. The ink tank according to claim 1, wherein the outer and inner walls are bonded to each other both in the first and second regions, and a bonding force between the inner and outer walls in the second region is larger than that in the first region.

4. The ink tank according to claim 1, further comprising a bonding portion in a region other than the first and second regions and adjacent to the liquid feeding port so as to maintain a state in which the inner and outer walls are bonded to each other after the liquid is guided out.

5. An ink tank comprising:

an inner wall having an approximate prism-like shape and forming a liquid containing portion for storing liquid;

an outer wall, having inner surfaces whose shapes are substantially the same as those of outer surfaces of the inner wall, comprising at least one atmospheric-air communicating portion for introducing atmospheric air into a space between the inner wall and the inner surfaces of the outer wall; and a liquid feeding port for feeding liquid in the liquid containing portion to the outside, wherein the inner wall is separable from the outer wall as the liquid is being guided out from the liquid feeding port, wherein the liquid feeding port is disposed on a surface of the inner wall except the largest-area surface of the same, and wherein a thickness distribution of each largest-area surface of the inner wall varies continuously so as to become larger from a position remote from the liquid feeding port toward the liquid feeding port.

6. The ink tank according to claim 5, further comprising:

a first region, on the largest-area surface, in which the inner and outer walls are bonded to each other and are separable from each other by an external force; and a second region, on the largest-area surface, in which the inner and outer walls are bonded to each other and a larger external force is needed to separate the inner wall from the outer wall than in the first region, wherein, as the liquid is being guided out, the inner wall separates from the outer wall first in the first region and then in the second region.

* * * * *